US006041950A

United States Patent [19]

Soehnlein

[11] Patent Number: 6,041,950

[45] Date of Patent: Mar. 28, 2000

[54] METHOD AND APPARATUS FOR WEANING AN INFANT

[76] Inventor: Marilyn A. Soehnlein, 4979 Main St., PO Box 475, Bemus Point, N.Y. 14712

[21] Appl. No.: 08/943,635

[22] Filed: Oct. 3, 1997

[51] Int. Cl.[7] ..... A61J 9/00

[52] U.S. Cl. ..... 215/11.1; 606/234

[58] Field of Search ..... 606/234, 235, 606/236; 215/11.1, 11.3, 11.4, 11.5, 11.6

[56] References Cited

U.S. PATENT DOCUMENTS

| | | | |
|---|---|---|---|
| D. 87,240 | 6/1932 | Podell . | |
| D. 336,520 | 6/1993 | McDaniel . | |
| D. 353,461 | 12/1994 | Byrd . | |
| 1,826,943 | 10/1931 | Maker . | |
| 2,223,179 | 11/1940 | Lougheed | 215/11.1 |
| 2,824,561 | 2/1958 | Mueller . | |
| 3,875,940 | 4/1975 | Beuther . | |
| 4,765,497 | 8/1988 | Hsu | 215/11.1 |
| 4,856,519 | 8/1989 | Teves . | |
| 5,133,740 | 7/1992 | Kussick | 606/236 |
| 5,284,490 | 2/1994 | Green . | |
| 5,342,398 | 8/1994 | Sun | 606/235 |
| 5,395,392 | 3/1995 | Suhonen | 606/234 |
| 5,606,871 | 3/1997 | Hansen et al. | 606/235 X |
| 5,653,732 | 8/1997 | Sheehy | 606/236 |
| 5,711,759 | 1/1998 | Smith et al. | 606/234 X |

*Primary Examiner*—Gary E. Elkins
*Assistant Examiner*—Tri M. Mai
*Attorney, Agent, or Firm*—The Bilicki Law Firm, P.C.

[57] ABSTRACT

A weaning system for weaning a child off sucking devices, comprising a series of nipples, each nipple of the series having a wall and an external surface, the external surface of each nipple having at least one aberration, the external surface of each successive nipple of the series being rougher than the external surface of the preceding nipple.

15 Claims, 8 Drawing Sheets

METHOD AND APPARATUS FOR WEANING AN INFANT

FIELD OF THE INVENTION

This invention relates generally to pacifiers and bottle nipples. More specifically, it provides a series of modified pacifiers or bottle nipples for weaning an infant or a child from the use of pacifiers or feeding bottles.

BACKGROUND OF THE INVENTION

Many infants derive comfort from sucking on a pacifier or a bottle nipple. Infants who become dependent on pacifiers for comfort are reluctant to relinquish them as they grow up. As a result, the habit of sucking a pacifier or a bottle nipple is sometimes carried over into early childhood. Continued use of sucking devices beyond the age of one year can lead to health-related problems. Pacifier or bottle-nipple sucking by an older child causes drooling and accumulation of moisture around the neck of the pacifier thereby increasing the risk of infection. In addition, continued use of the feeding bottle in older children can lead to dental caries especially if the bottle is used at bedtime. Furthermore, prolonged sucking of the bottle-nipple or pacifier can cause deformities in the child's teeth and roof of the mouth. Thus, it is desirable that sucking of pacifiers or bottle nipples not be continued beyond infancy.

The most commonly used method of weaning a child from the use of pacifiers is to abruptly stop giving the pacifier to the child. This often leads to prolonged episodes of crying by the child and considerable anxiety for the parents. Therefore, weaning a child from the use of a pacifier or a bottle nipple can be an emotional struggle for both the child and the parent.

Generally, the pacifiers or nipples that most infants become dependent upon have a smooth surface. Thus it may appear that the smooth texture of the nipple surface is desirable for infants to suck on. However, many sucking devices are disclosed in the literature that have modified surfaces. Such modifications are purported to provide a soothing or massaging effect, or provide a mode for delivery of materials through the nipple.

Pacifiers with projections on the nipple surface have been described as teething or gum massaging devices. U.S. Pat. No. 1,826,943 (Maker) describes a pacifier having tiny projections on its surface. The pacifier is elliptical at one end and lobular at the other. The lobular end is generally held by the infant in the mouth. Two holes run along the length of the lobular part of the pacifier. The device soothes and massages gums during teething and free admission of air through the holes discourages any tendencies of sucking. U.S. Pat. No. 5,284,490 (Green) describes a generally flat teething arrangement that has projections mounted to its top and bottom surfaces. When an infant sucks or chews on the teething arrangement, the projections massage the infant's gums. U.S. Pat. No. Des. 87,240 (Podell), and Des. 336,520 (McDaniels) also disclose pacifiers having projections on their surface.

Pacifiers or sucking devices with perforations in their surface have generally been used previously to provide liquids to infants and other individuals. U.S. Pat. No. 2,824,561 (Mueller) describes a combined infant pacifier and feeding device. The body of the pacifier is provided with a number of perforations. A liquid can be supplied to the body so that upon sucking, the liquid will be available to the infant through the perforations. U.S. Pat. No. 3,875,940 (Beuther) describes a sucking device that is fork shaped so as to fit around the teeth in an individual's mouth. The device has apertures at one end and can receive liquid from the other. The device is designed for individuals whose diet is restricted to liquids. U.S. Pat. No. 4,856,519 (Teves) describes a sound generating pacifier that has a hole in the nipple so as to allow air to enter the pacifier, which is then directed to produce sound. In addition, Des. 353,461 (Byrd) discloses a pacifier with perforations.

While many pacifiers or devices are known in the literature that have modified surfaces, none of these devices can be used to wean an infant or a child who is in the habit of sucking on a pacifier or bottle nipple. In all of the previous devices, projections or openings are made so as to render the device more desirable which leads to a greater dependency of the child on the device. A need therefore exists for a system wherein sucking a pacifier gradually becomes less satisfying to the child so that the child does not want the pacifier any more and therefore is weaned from it without the usual emotional trauma involved with such weaning.

SUMMARY OF THE INVENTION

This invention broadly comprises a weaning system for weaning a child off sucking devices, comprising a series of nipples, each nipple of the series having a wall with an external surface, the external surface of each nipple having at least one aberration, the external surface of each successive nipple of the series being rougher than the external surface of the preceding nipple.

An object of the present invention is to provide a series of nipples wherein each successive nipple of the series becomes less desirable for the child than the preceding nipple.

Another object of the present invention is to provide a series of nipples that have aberrations on the external surface, with the aberrations on each successive nipple of the series providing greater roughness to the external surface of the nipple than the aberrations of the preceding nipple.

BRIEF DESCRIPTION OF THE DRAWINGS

FIG. 1*aa* is a cross section of the pacifier in FIG. 1*a;*

FIG. 1*bb* is a cross section of the pacifier in FIG. 1*b;*

FIG. 1*cc* is a cross section of the pacifier in FIG. 1*c;*

FIG. 1*dd* is a cross section of the pacifier in FIG. 1*d;*

FIG. 1*ee* is a cross section of the pacifier in FIG. 1*e;*

FIG. 2*aa* is a cross section of the bottle nipple in FIG. 2*a*;

FIG. 2*bb* is a cross section of a bottle nipple in FIG. 2*b*;

FIG. 2*cc* is a cross section of the bottle nipple hacing indentations on the surface wiht one indentation traversing the entire surface;

FIG. 2*dd* is a cross section of the bottle nipple in FIG. 2*d*;

FIG. 3*aa* is a cross section of the pacifier in FIG. 3*a;*

FIG. 3*bb* is a cross section of the pacifier in FIG. 3*b;*

FIG. 3*cc* is a cross section of the pacifier in FIG. 3*c;*

FIG. 3*dd* is a cross section of the pacifier in FIG. 3*d;*

FIG. 3*ee* is a cross section of the pacifier in FIG. 3*e;*

FIG. 4*aa* is a cross section of the bottle nipple in FIG. 4*a;*

FIG. 4*bb* is a cross section of the bottle nipple in FIG. 4*b;*

FIG. 4*cc* is a cross section of the bottle nipple in FIG. 4*c;*

FIG. 4*dd* is a cross section of the bottle nipple in FIG. 4*d;*

FIG. 4*ee* is a cross section of the bottle nipple in FIG. 4*e;*

DETAILED DESCRIPTION OF THE PREFERRED EMBODIMENT

Figure 1A:
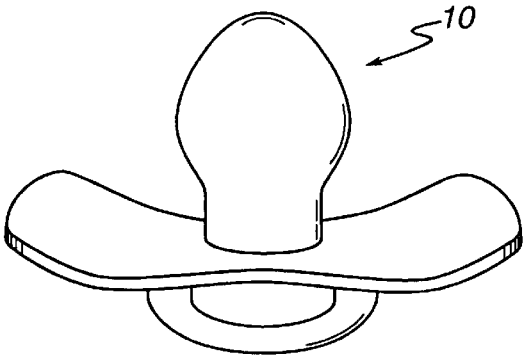
FIG. 1*a* is a perspective view of a pacifier with a smooth surface.
Figure 1A:
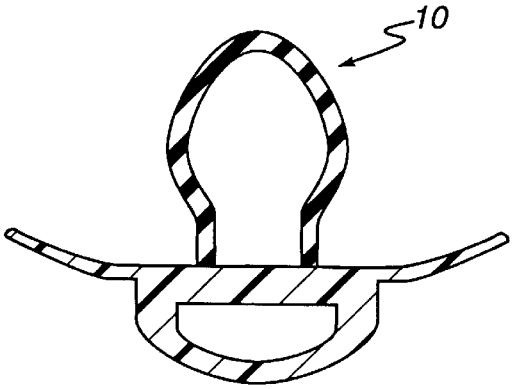
Figure 1B:
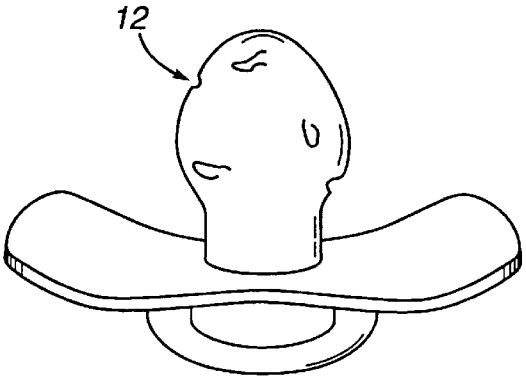
FIG. 1*b* is a perspective view of a pacifier having indentations on the external surface.
Figure 1B:
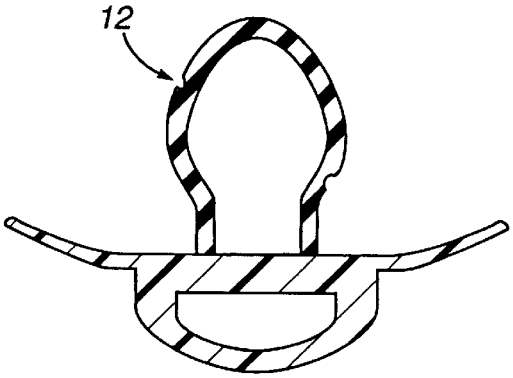
Figure 1C:
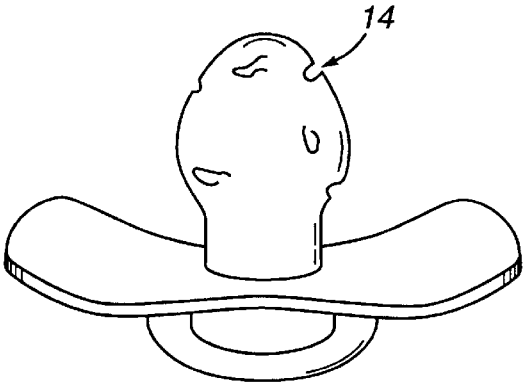
FIG. 1*c* is a perspective view of a pacifier having indentations on the surface with one indentation traversing the entire thickness of the wall.
Figure 1C:
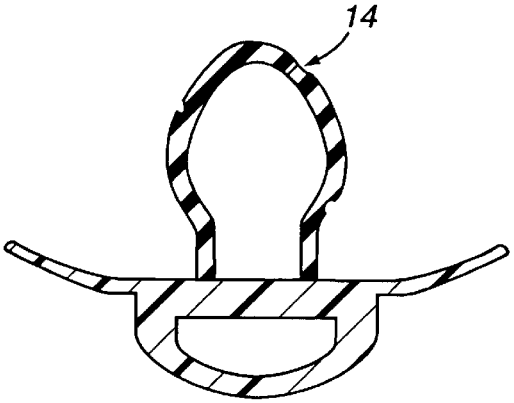
Figure 1D:
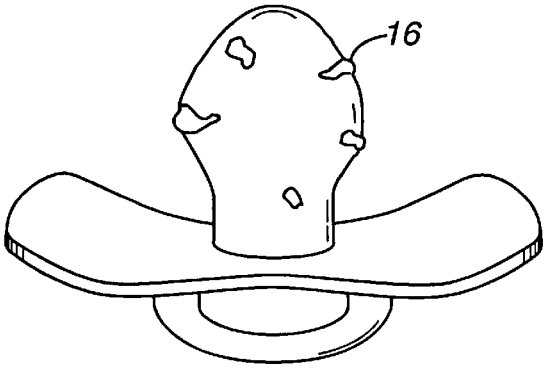
FIG. 1*d* is a perspective view of a pacifier having protuberances on the external surface.
Figure 1D:
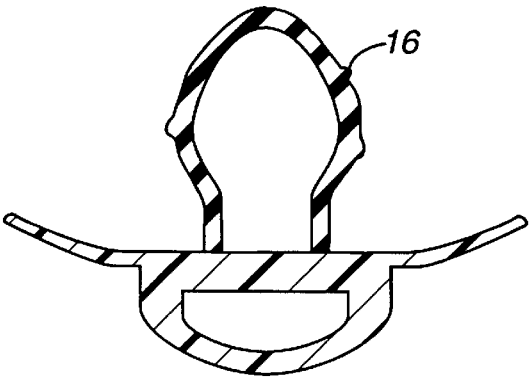
Figure 1E:
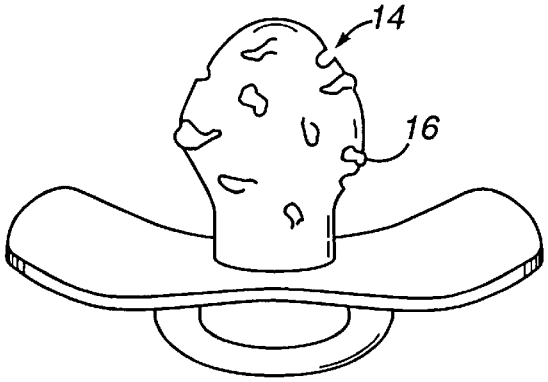
FIG. 1*e* is a perspective view of a pacifier having indentations and protuberances on the surface.
Figure 1E:
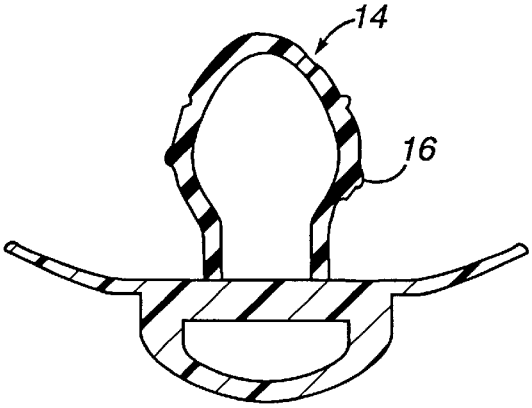
Figure 2A:
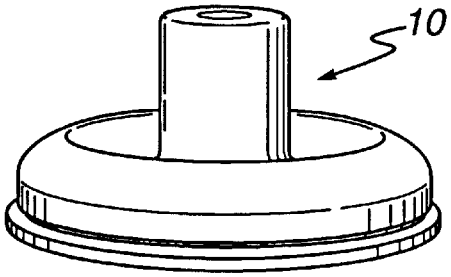
FIG. 2*a* is a perspective view of a bottle nipple having a smooth surface.
Figure 2A:
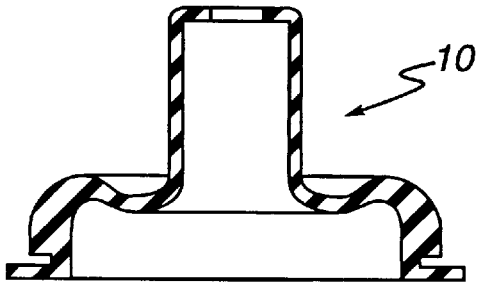
Figure 2B:
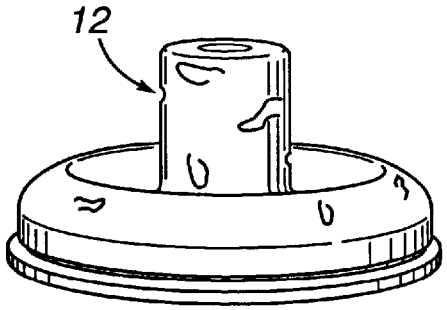
FIG. 2*b* is a perspective view of a bottle nipple having indentations on the surface.
Figure 2B:
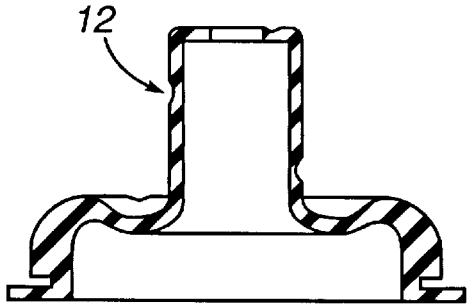
Figure 2C:
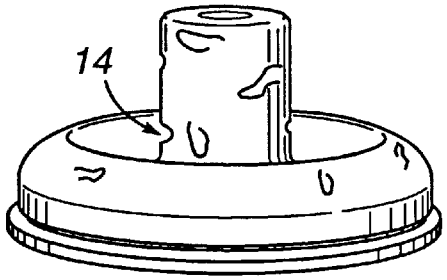
FIG. 2*c* is a perspective view of a bottle nipple having indentations on the surface with one indentation traversing the entire surface.
Figure 2C:
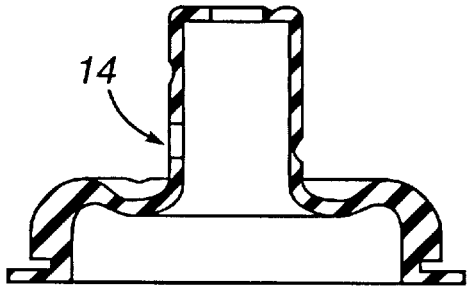
Figure 2D:
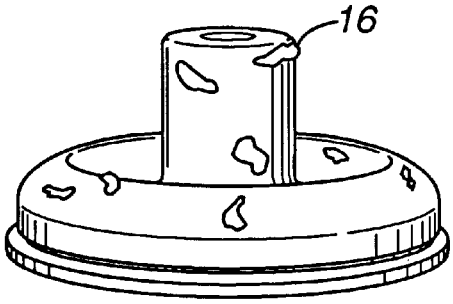
FIG. 2*d* is a perspective view of a bottle nipple having protuberances on the surface.
Figure 2D:
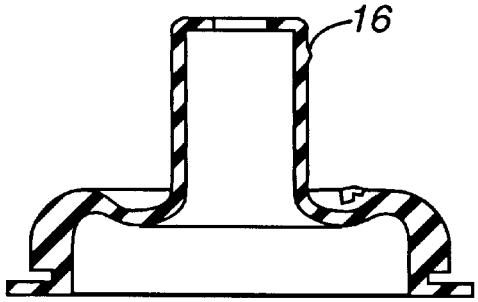
Figure 2E:
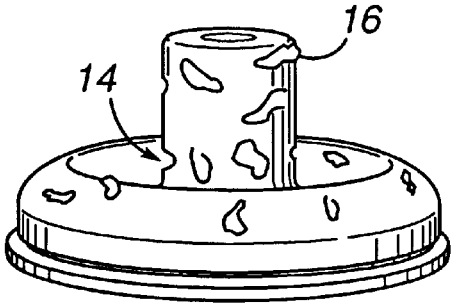
Figure 2E:
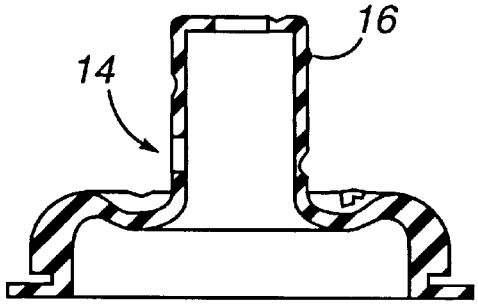

The weaning system of the present invention involves a series of nipples that could be used by children of any age who are dependent on sucking devices for comfort. The nipples can be the type used in feeding bottles or can be integral to pacifiers. The external surface of each nipple of the series is such that sucking on it is less desirable or comfortable for the child than sucking on the previous nipple in the series. Nipples are made undesirable for sucking by making their surface rough. As illustrated in FIGS. 1*a*–1*e* and 2*a*–2*e*, the texture of a nipple 10 can be made rough by introducing aberrations on its external surface. FIG. 1*a* and 2*a* illustrate a normal pacifier nipple and a normal bottle nipple. FIG. 1*aa* and 2*aa* are the corresponding cross sections of the pacifiers shown in FIG. 1*a* and 2*a*. In a preferred embodiment, the roughness is achieved by making indentations 12 on the surface of the nipple of a pacifier or a bottle cap as illustrated in FIG. 1*b* and 2*b* respectively and in their corresponding cross sections in FIG. 1*bb* and 2*bb*. The indentations may be traversing indentations 14, which traverse the entire thickness of the nipple wall as illustrated in FIG. 1*c* and 2*c*, and their corresponding cross sections FIG. 1*cc* and 2*cc*. In another preferred embodiment, the aberrations on the surface of the nipple are protuberances 16 as illustrated in FIG. 1*d* and 2*d* and their corresponding cross sections FIG. 1*dd* and 2*dd*. A combination of indentations and protuberances may also be used as illustrated in FIG. 1*e* and 2*e* and their corresponding cross sections 1*ee* 2*ee*.

The indentations are such that each successive pacifier in a series is less desirable for the child. The indentations can be of any size or shape and at any angle. "Small indentation", as used herein means indentations covering a surface area defined by dimensions of approximately ⅛" in length by 1/16" in width (or smaller dimensions). "Large indentations" as used herein means indentations covering a surface area of approximately ¼" in length by ⅛" in width, (or slightly larger dimensions). The traversing indentations can be angled or straight. The placement of the indentations can be random or concentrated in certain areas.

Projections or protuberances on the nipple surface can be of any size or shape so long as they are not sharp enough to injure the oral tissue of the child. In a preferred embodiment, the protuberances are nodules on the surface of the nipple. The placement of protuberances can be random or can be concentrated at a certain area on the pacifier. In a preferred embodiment, at least one protuberance is made of hard rubber so as to produce additional discomfort to the child while sucking.

Each successive pacifier of the series is made less comforting by increasing the roughness of its external surface. Increased roughness can be achieved by either increasing the number of aberrations or by making the aberrations more undesirable to suck on. For example, if the aberration is an indentation, the roughness of the external surface of a nipple may be increased by increasing the number of indentations or by making the indentations larger, deeper or more angled. If the aberration is a protuberance, the roughness of the nipple may be increased by increasing the number of protuberances, by increasing the size of the protuberances or by increasing the hardness of protuberances. In addition, various combinations of indentations and protuberances may be used.

The number of nipples in a series designated as stages that an infant or child will require before being weaned off is variable. Some children may need only one or two pacifiers in a series before relinquishing the habit while others may need more to be weaned. In a preferred embodiment, the number of stages is 1 to 20. In a more preferred embodiment, the number of stages is 5.

To use this invention, a parent would first give the child a pacifier or a bottle nipple having a smooth surface, similar to one that the child is used to. This is designated as Stage 1 pacifier. Shortly thereafter, the Stage 1 pacifier is replaced with the Stage 2 pacifier which has at least one aberration on its surface. Stage 2 pacifier is followed by Stage 3 pacifier and so on with the pacifier of each Stage providing increased roughness on the surface. As the stages get more uncomfortable to suck, the child receives less and less satisfaction from sucking the nipple and thereby relies less upon it. As a result, the child itself will give up the pacifier or feeding bottle.

Figure 3A:
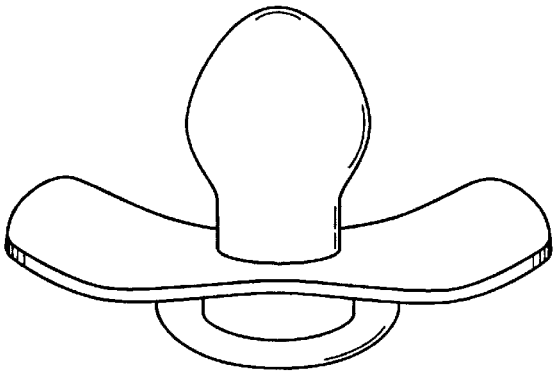
FIG. 3*a* is a perspective view of a Stage 1 pacifier.
Figure 3A:
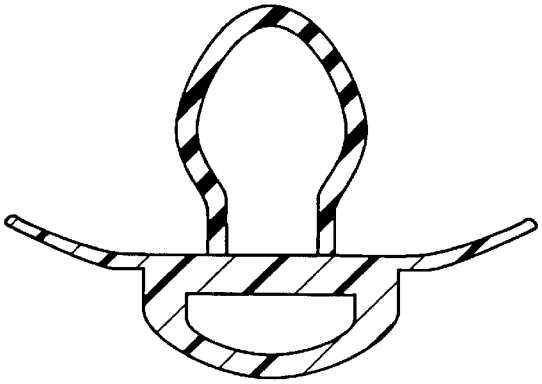
Figure 3B:
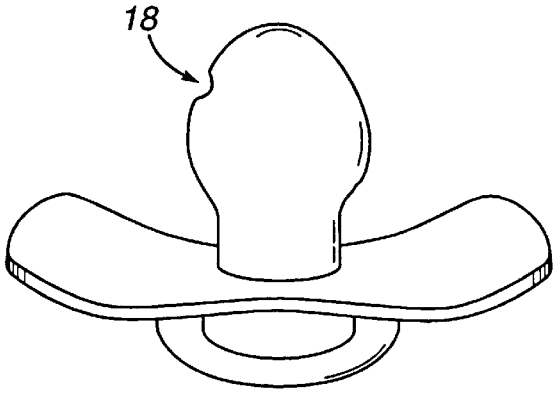
FIG. 3*b* is a perspective view of a Stage 2 pacifier.
Figure 3B:
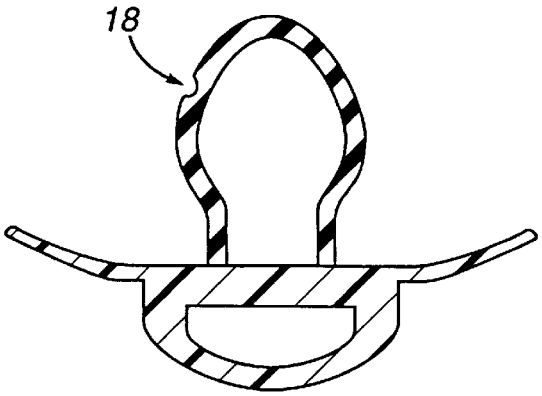
Figure 3C:
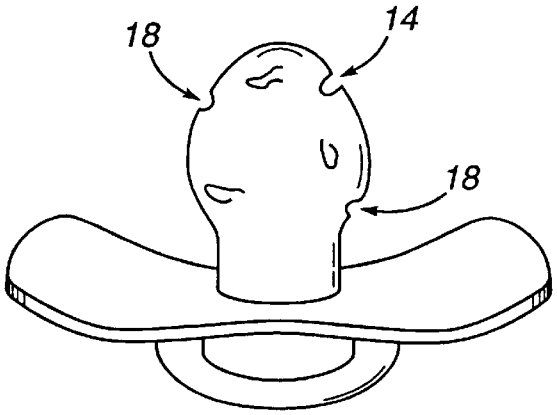
FIG. 3*c* is a perspective view of a Stage 3 pacifier.
Figure 3C:
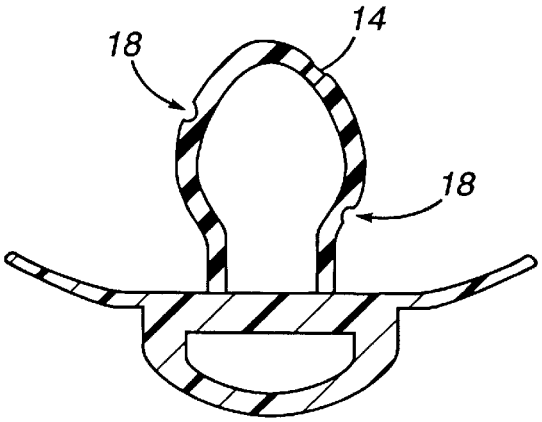
Figure 3D:
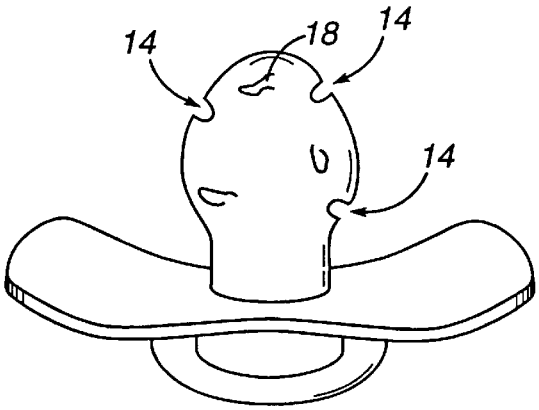
FIG. 3*d* is a perspective view of a Stage 4 pacifier.
Figure 3D:
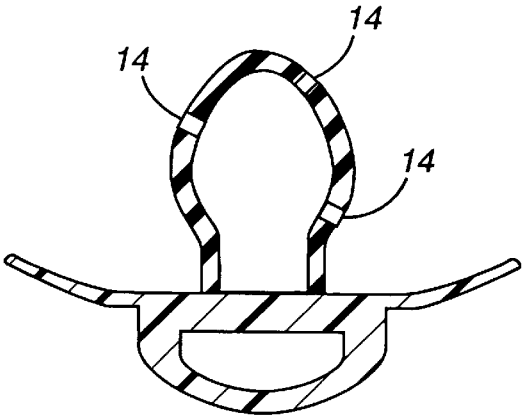
Figure 3E:
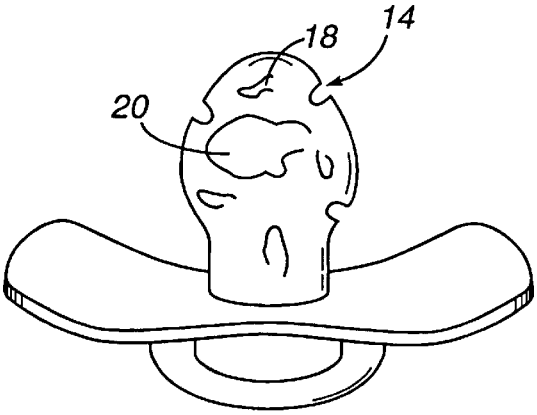
FIG. 3*e* is a perspective view of a Stage 5 pacifier.
Figure 3E:
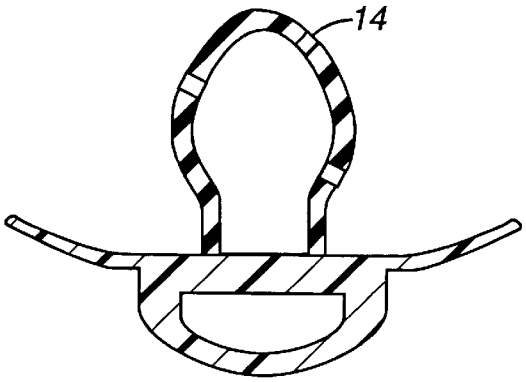

An illustrative series of pacifiers is shown in FIGS. 3*a*–3*e* and FIGS. 3*aa*–3*ee*. FIGS. 3*a* and 3*aa* show a Stage 1 pacifier. This is a normal pacifier that a child is used to and has a smooth surface. FIGS. 3*b* and 3*bb* illustrate a Stage 2 pacifier. This is similar to the Stage 1 pacifier except that it has one small indentation 18 on its external surface. FIGS. 3*c* and 3*cc* show a Stage 3 pacifier, which is the same as a Stage 2 pacifier except that it has a plurality of small indentations of the surface of the nipple and one indentation 14 traverses the entire depth of the nipple wall. FIGS. 3*d* and 3*dd* show a Stage 4 pacifier which is the same as Stage 3 pacifier except that the number of indentations that traverse the entire depth of the wall is greater than in Stage 3 pacifier. FIGS. 3*e* and 3*ee* illustrate Stage 5 nipple which is the same as a Stage 4 pacifier except that it has one large indentation 20 .

Figure 4A:
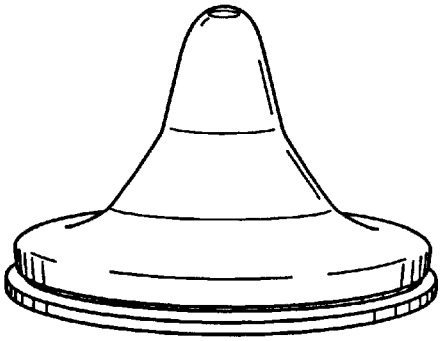
FIG. 4*a* is a perspective view of a Stage 1 bottle nipple.
Figure 4A:
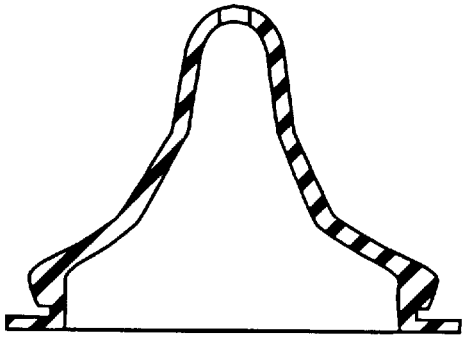
Figure 4B:
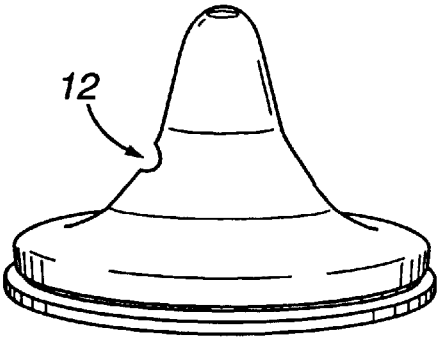
FIG. 4*b* is a perspective view of a Stage 2 bottle nipple.
Figure 4B:
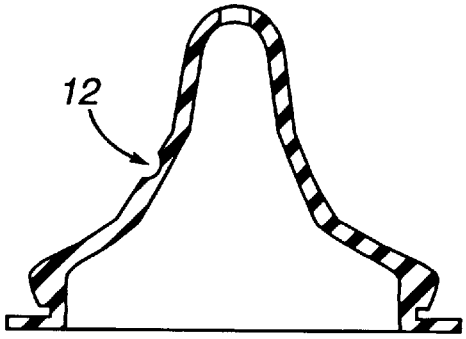
Figure 4C:
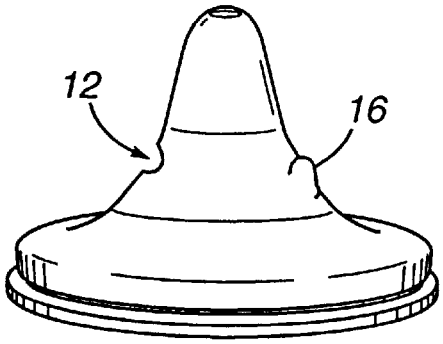
FIG. 4*c* is a perspective view of a Stage 3 bottle nipple.
Figure 4C:
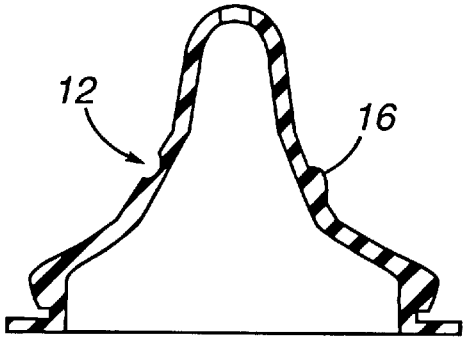
Figure 4D:
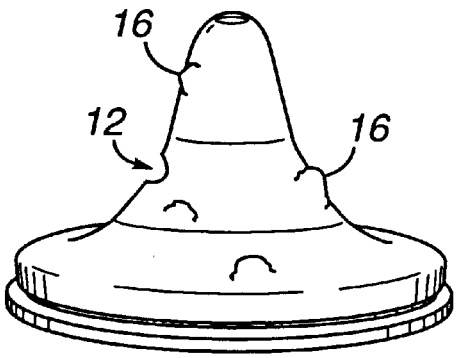
FIG. 4*d* is a perspective view of a Stage 4 bottle nipple.
Figure 4D:
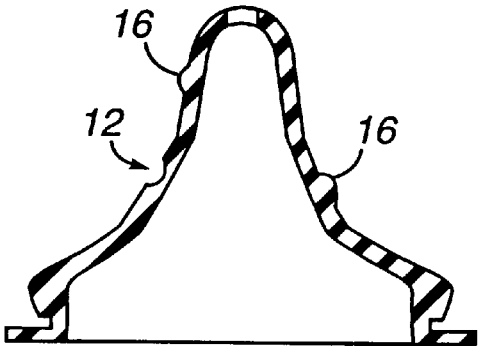
Figure 4E:
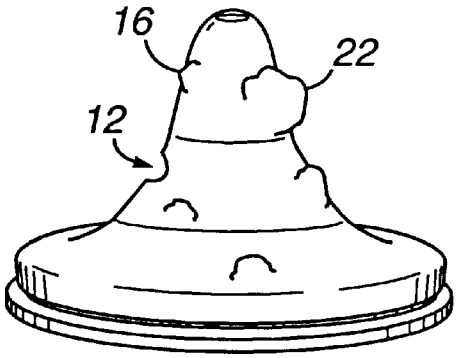
FIG. 4*e* is a perspective view of a Stage 5 bottle nipple.
Figure 4E:
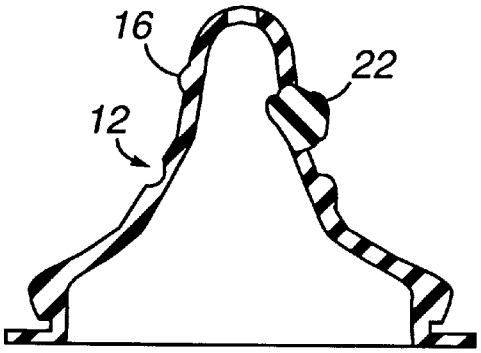

Another illustative series of nipples is shown in FIGS. 4*a*–4*e* and FIGS. 4*aa*–4*ee*. FIGS. 4*a* and 4*aa* show a normal bottle nipple. FIGS. 4*b* and 4*bb* show a Stage 2 bottle nipple which is similar to Stage 1 nipple except that it has one indentation on the surface of the nipple. FIGS. 4*c* and 4*cc* show a Stage 3 bottle nipple. This is the same as Stage 2 nipple except that in addition, it has one protuberance on the surface. FIGS. 4*d* and 4*dd* illustrate a Stage 4 bottle nipple which is the same as a Stage 3 nipple except that it has more protuberances than the Stage 3 nipple. FIGS. 4*e* and 4*ee* illustrate a Stage 5 bottle nipple which is the same as a Stage 4 nipple except that it has an additional protuberance made of hard rubber 22.

The preferred embodiments described herein are not intended to limit the scope of the present invention. It is appreciated that various modifications to the inventive concepts described herein may be apparent to those skilled in the art without departing from the spirit of the present invention defined by the hereafter appended claims.

What is claimed is:

1. A weaning system for weaning a child off sucking devices, comprising a series of nipples, each nipple of said series having a wall, said wall having an external surface, said external surface of each nipple having at least one aberration, said external surface of each successive nipple of said series being rougher than the external surface of the preceding nipple.

2. The weaning system of claim 1, wherein the external surface of each successive nipple has at least one aberration more than the external surface of the preceding nipple.

3. The weaning system of claim 1, wherein the nipple is an integral part of a pacifier.

4. The weaning system of claim 1, wherein the aberration is selected from a group consisting of an indentation and a protuberance.

5. The weaning system of claim 4, wherein at least one protuberance is made of hard rubber.

6. The weaning system of claim 5, further comprising:

A first nipple, wherein the surface of said first nipple is substantially smooth.

7. The weaning system of claim 6, wherein the indentations are selected from a group consisting of a small indentation, a large indentation and a traversing indentation, and wherein the series of nipples comprises:

a second nipple having one small indentation;

a third nipple having a plurality of small indentations and at least one traversing indentation;

a fourth nipple, having a plurality of small indentations and a plurality of traversing indentations;

a fifth nipple having a plurality of small indentations, a plurality of traversing indentations, and at least one large indentation.

8. The weaning system of claim 6, wherein the series comprises:

a second nipple having one small indentation;

a third nipple having a plurality of small indentations and one protuberance;

a fourth nipple having a plurality of small indentations and a plurality of protuberances;

a fifth nipple having a plurality of small indentations, a plurality of protuberances wherein at least one protuberance is made of hard rubber.

9. A method for weaning a child off the use of a sucking device, comprising the steps of:

a. giving the child a first nipple having a smooth surface; and b. giving the child a series of nipples, each nipple of said series having a wall, said wall having an external surface, said external surface of each nipple having at least one aberration, said external surface of each successive nipple of said series being rougher than the external surface of the preceding nipple.

10. The method of claim 9, wherein the external surface of each successive nipple has at least one aberration more than the external surface of the preceding nipple.

11. The method of claim 9, wherein the nipple is an integral part of the pacifier.

12. The method of claim 9, wherein the aberration is selected from the group consisting of an indentation and a protuberance.

13. The method of claim 12, wherein at least one protuberance is made of hard rubber.

14. The method of claim 12, wherein the indentation is selected from the group consisting of a small indentation, a large indentation and a traversing indentation, and wherein said series comprises:

a second nipple having one small indentation;

a third nipple having a plurality of small indentations and at least one traversing indentation;

a fourth nipple, having a plurality of small indentations and a plurality of traversing indentations;

a fifth nipple having a plurality of small indentations, a plurality of traversing indentations, and at least one large indentation.

15. The method of claim 12, wherein the indentation is a small indentation and wherein the series comprises:

a second nipple having one small indentation;

a third nipple having a plurality of small indentations and one protuberance;

a fourth nipple having a plurality of small indentations and a plurality of protuberances;

a fifth nipple having a plurality of small indentations, a plurality of protuberances wherein at least one protuberance is made of hard rubber.

* * * * *